United States Patent [19]

Dechelette

[11] Patent Number: 4,512,619

[45] Date of Patent: Apr. 23, 1985

[54] INSULATION DISPLACEMENT TERMINAL FOR AN ELECTRICAL CONNECTOR AND ENVIRONMENTAL SEALING MEANS THEREFOR

[75] Inventor: Helen Dechelette, London, England

[73] Assignee: Molex Incorporated, Lisle, Ill.

[21] Appl. No.: 515,428

[22] Filed: Jul. 20, 1983

[30] Foreign Application Priority Data

| | | | |
|---|---|---|---|
| Jul. 23, 1982 | [GB] | United Kingdom | 8221411 |
| Aug. 9, 1982 | [GB] | United Kingdom | 8222891 |
| Jul. 6, 1983 | [GB] | United Kingdom | 8318283 |

[51] Int. Cl.[3] ..... H01R 4/24; H01R 13/58

[52] U.S. Cl. ..... 339/94 M; 339/97 P; 339/100; 339/103 M

[58] Field of Search ..... 339/96, 97 R, 97 C, 339/97 P, 98, 99 R, 94 R, 94 M, 100, 75 R, 75 M, 80, 103 R, 103 M

[56] References Cited

U.S. PATENT DOCUMENTS

| | | | |
|---|---|---|---|
| 3,553,631 | 1/1971 | Shlesinger, Jr. | 339/97 P |
| 4,090,764 | 5/1978 | Malsby et al. | 339/103 M |
| 4,352,240 | 10/1982 | Komada | 339/100 X |
| 4,438,997 | 3/1984 | Evans | 339/97 R |
| 4,445,748 | 5/1984 | Evans | 339/94 M |

FOREIGN PATENT DOCUMENTS

| | | | |
|---|---|---|---|
| 52037 | 5/1982 | European Pat. Off. | 339/99 R |
| 1109914 | 4/1968 | United Kingdom | 339/97 R |

*Primary Examiner*—Gil Weidenfeld
*Assistant Examiner*—Steven C. Bishop
*Attorney, Agent, or Firm*—Louis A. Hecht

[57] ABSTRACT

A collapsible insulation displacement terminal, responsive to an actuating force directed along the length of a wire received in the terminal, includes a metallic body with a pair of side portions positionable on opposite sides of an insulation covered wire. Each side portion includes a weakened intermediate region with an aperture defined therein. When the terminal is compressed by a force applied generally parallel to the length of the wire, the intermediate regions collapse inwardly of the terminal body toward one another. In the process, a contact edge defined by the apertures severs the insulation covering the wire and produces an electrical connection between the central core of the wire and the terminal. The positions of the intermediate regions of the side portions may be offset with respect to one another so that the two intermediate portions do not interfere with one another during their inward severing action. The terminal may be adapted for use with a coaxial cable wherein the intermediate portions produce an electrical connection only with the shielding conductor of the cable. A dielectric housing for the terminal may include pre-assembled sealing means through which the wire is inserted prior to application of the collapsing force to the terminal.

19 Claims, 11 Drawing Figures

INSULATION DISPLACEMENT TERMINAL FOR AN ELECTRICAL CONNECTOR AND ENVIRONMENTAL SEALING MEANS THEREFOR

BACKGROUND OF THE INVENTION

1. Field of the Invention

This invention relates generally to electrical connectors, and specifically, to connectors having the capability of terminating electrical cable or wiring by the method of insulation displacement.

2. Brief Description of the Prior Art

Electrical connectors have become widely accepted as a preferred means for interconnecting the circuitry components of electrically operated products and equipment. In such applications, providing for the facile connection and disconnection of cable or wire through the use of connectors permits convenience of assembly and maintenance as well as versatility in design.

Connectors in current use are of diverse construction. However, a common arrangement includes a dielectric housing fitted with a plurality of stamped and formed conductive terminals to which insulated multi-conductor cable or wiring may be electrically connected. Numerous terminal configurations are likewise available, suited to the specific requirements of the application. A preferred terminal in many applications is one which has the capability of establishing electrical contact with the conductors of the cable by displacement of the insulative coating of the conductors, obviating the need to perform the separate step of stripping the insulative coating.

A wide variety of insulation displacement terminals are known in the art. U.S. Pat. No. 4,217,022 to Carre, for example, discloses an insulation displacement terminal which is representative of the type of terminal currently in widespread use. Generally, these terminals provide a narrow slot which receives an insulation covered wire, severs the insulation covering of the wire in the process, and establishes, automatically, an electrical connection between the terminal and the central core of the wire. This is contrasted with the self-piercing type of terminals which usually have sections in the form of teeth that pierce the insulation and enter the metallic core when the terminal is clinched or secured to the wire.

Both the self-piercing and insulation displacement terminals, as previously known in the art, suffer from a number of disadvantages. First, both techniques have limitations in terms of the acceptable wire dimensions which may be used in connection with a specific terminal. In addition, currently known terminals generally require a transverse actuating force to be applied in order to establish the electrical connection. That is, a force must be applied transversely to the length of the wire requiring the wire to be accessible to the transversely applied force at the terminal. Where it is desired that the terminals are prefitted into the connector housing prior to wire termination, the requirement of transverse terminal accessibility prevents the close spacing of a plurality of connections. This condition is particularly limiting where multiple rows of circuit connections are desired.

It is known that conventional wire terminating techniques frequently require two or more operations including the steps of inserting the wire into the connector and thereafter crimping or actuating the terminal in order to establish the connection. These separate operations typically involve significant expeditures of assembly time and tooling investment. When only one step is required, such as forcing a wire sideways into an insulation displacement terminal, the operation is usually awkward due to the transverse flexibility of the wire. As a consequence, considerable care is required to assure the proper termination of the wire or cable to the connector.

A further limitation of the prior art resides in the difficulties associated with sealing a conventional connector housing against environmental degrading of the electrical connections contained within it. This limitation is particularly present in the case of conventional insulation displacement connectors which, as heretofore discussed, require transverse accessibility to the wire in the region of the terminal during the final wire termination process.

SUMMARY OF THE INVENTION

It is, therefore, the principal object of the present invention to provide a terminal which enables an electrical connection to be established with a wire upon application of an axial force directed generally parallel to the longitudinal axis of the wire.

It is another object of the present invention to provide an electrical terminal which enables a plurality of such terminals of be positioned within a connector housing in a closely arranged array.

It is still another object of the present invention to provide an insulation displacing terminal amenable to use with wires having a wide variety of diameters.

A still further object is to provide an electrical connector having insulation displacement terminals together with means for inexpensively and conveniently sealing the terminals against adverse environmental conditions.

In one form of the invention currently contemplated, an insulation displacement terminal includes a metal housing positionable about an insulation covered wire. The housing includes an insulation severing edge portion. Also provided is a means for displacing the severing edge into the insulation covering of the wire generally transverse to the length of the wire in response to an actuating force applied to the housing generally parallel to the length of the wire.

Figure 8:
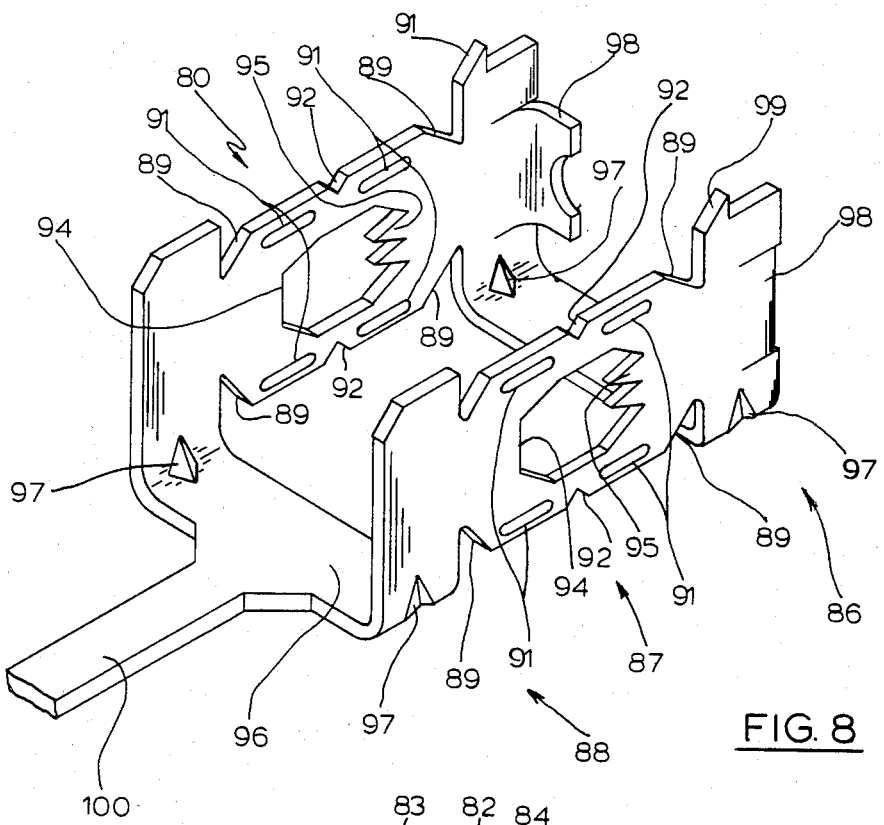
Figure 9:
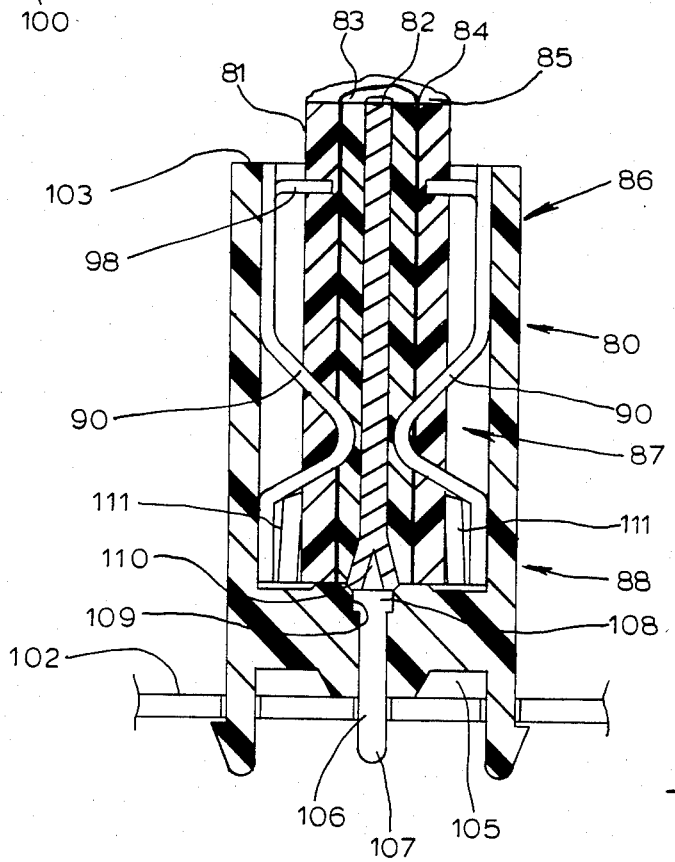

FIGS. *7a*, *7b* and *7c* illustrate a second embodiment of the present invention comprising a modified terminal adapted for use with differing gauges of wire;

FIG. 8 is a perspective view of a third embodiment of the present invention illustrating a terminal adapted for use with shielded cable; and FIG. 9 is a cross-sectional view of a shielded cable connector employing the terminal illustrated in FIG. 8.

DESCRIPTION OF THE PREFERRED EMBODIMENTS

Figure 1:
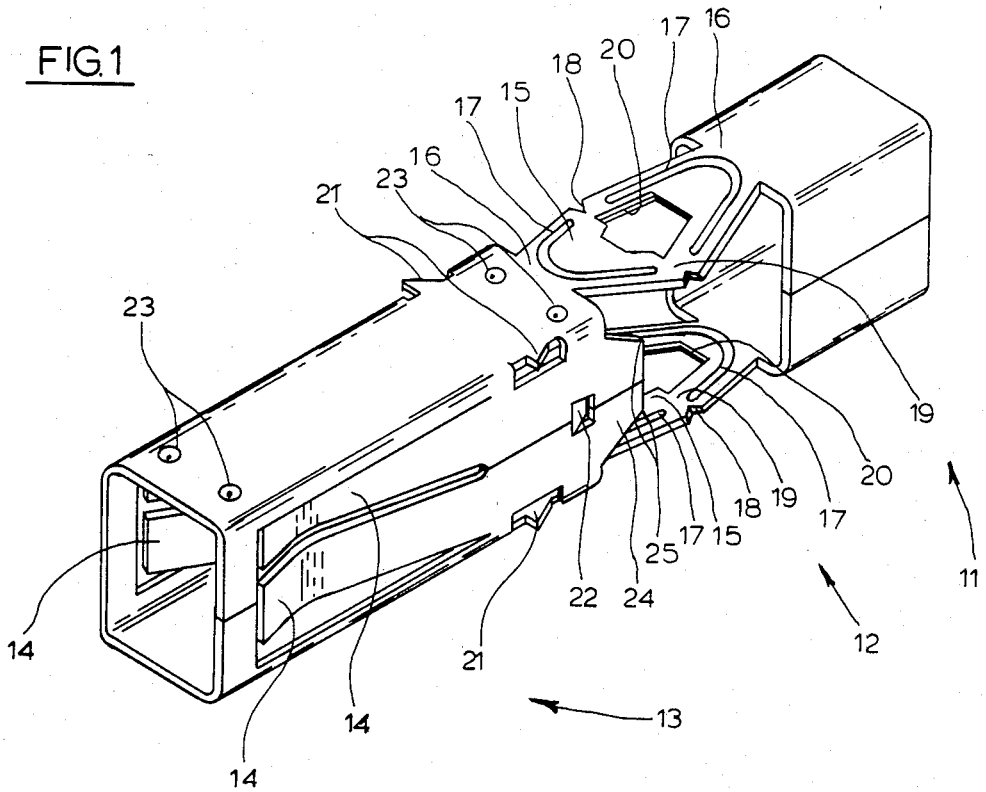
FIG. 1 is a perspective view of an insulation displacement terminal constructed in accordance with the principles of the present invention.

Turning now to the drawings, FIG. 1 illustrates a box type terminal, designated generally by the reference numeral 10, formed from a folded sheet metal blank (not shown). The terminal 10 has a plain, rectangular, first housing end portion 11, an intermediate collapsible portion 12, and a second housing end portion 13 which has a pair of cantilevered resilient contact beams 14 struck from each of two opposed side walls thereof. The beams 14 define a female terminal adapted to mate with a male contact pin (not shown) introduced therebetween.

The intermediate collapsible portion 12 comprises a pair of opposed contacting sections 15 each formed integrally with end portions 11 and 13 along a line of reduced width 16 such that sections 15 may be bent inwardly into a shallow V-shape. Each section 15 is formed with a pair of generally V-shaped reinforcing ribs 17 and a pair of edge notches 18 positioned intermediately between the ribs 17. The notches 18 and ribs 17 of each section 15 combine to define an axis 19 about which the section 15 may be bent. A polygonal aperture 20 is formed in each of the contacting sections 15 with an assymetrical shape with respect to the axis of bending 19. In stamping of the terminal 10, the edges of the apertures 20 are suitably chamfered to possess a relative knife-like sharpness to the insulative coating of a typical electrical cable or wire.

Teeth 21 project from the edges of end portion 13 and serve to secure the terminal in position in a connector housing. End portion 13 is also adapted with inwardly projecting wire stops 22 (only one of which can be seen) so as to constitute a stop for the end of a conductor wire inserted into end portion 11 of the terminal. Protrusions 23 are pressed outwardly of the side walls of the end portion 13 for facilitating sliding of the end portion 13 within the cavity of a connector housing, in a manner which will be described in greater detail, hereinafter. Additionally, ears 24 (only one of which can be seen) extend from the side walls of housing end portion 13 into the intermediate portion 12, each being configured with a pair of pivot points 25 for purposes which will likewise be discussed hereinafter.

Figure 2:
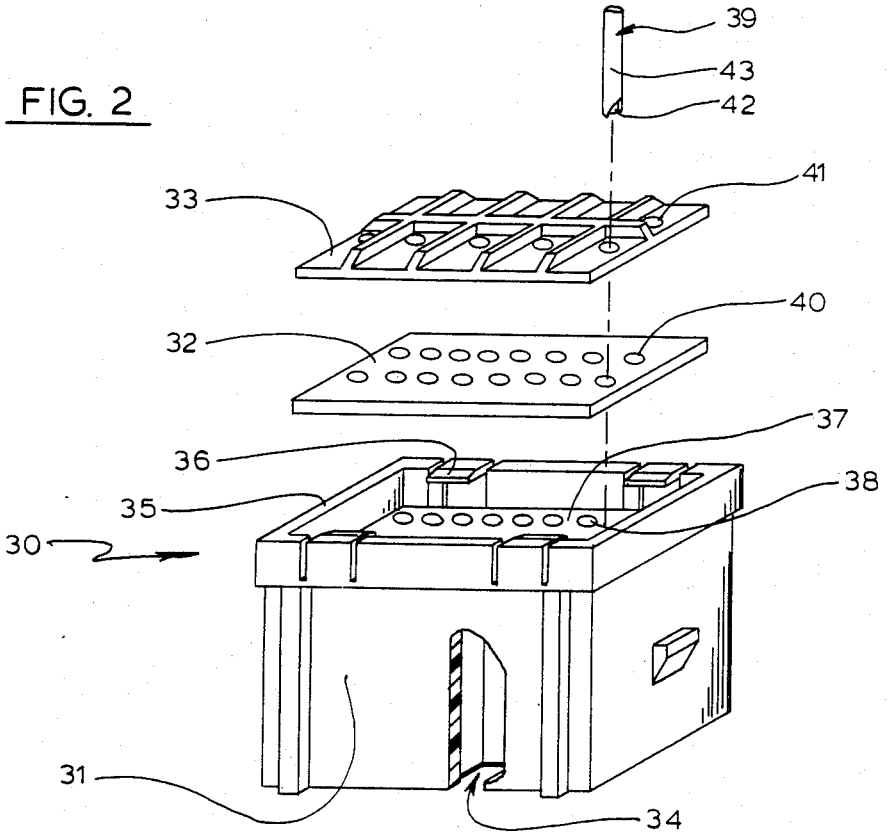
FIG. 2 is an exploded perspective view, partially in section, of an exemplary environmentally sealed connector in accordance with the principles of the present invention.

Turning now to FIG. 2 there is shown an exemplary connector assembly, designated generally by the reference numeral 30, suitable for utilization of the collapsible terminal 10 of FIG. 1. The connector assembly 30 comprises a one-piece housing 31, a gasket 32 and a gasket retainer 33. Formed within the housing 31 are a plurality of cavities, designated generally by the reference numeral 34, corresponding in number to the number of circuits which the connector is capable of terminating. Each cavity 34 is suitably dimensioned to slidingly receive a terminal 10.

The housing 31 is further adapted with an upstanding rim 35 for properly locating the gasket 32 and retainer 33. Integrally formed latching arms 36 serve to secure the retainer 33 in compression with the gasket 32 when it is desired that the connector housing 31 be environmentally sealed. Enclosing the cavities 34 at their upper ends, as viewed in FIG. 2, is a housing wall 37 having apertures 38 aligned with the vertical center-line of each cavity 34 for receiving the end of a wire 39 to be terminated. Corresponding apertures 40 and 41 are likewise formed in the gasket 32 and retainer 33, respectively. The wire 39 is illustrated as a discrete single-conductor wire having a conductive core 42 enveloped in a coating of insulation 43, although other types of wire such as ribbon cable, for example, are adaptable for use with the instant connector assembly 30 within the ordinary skill in the art.

Figure 3:
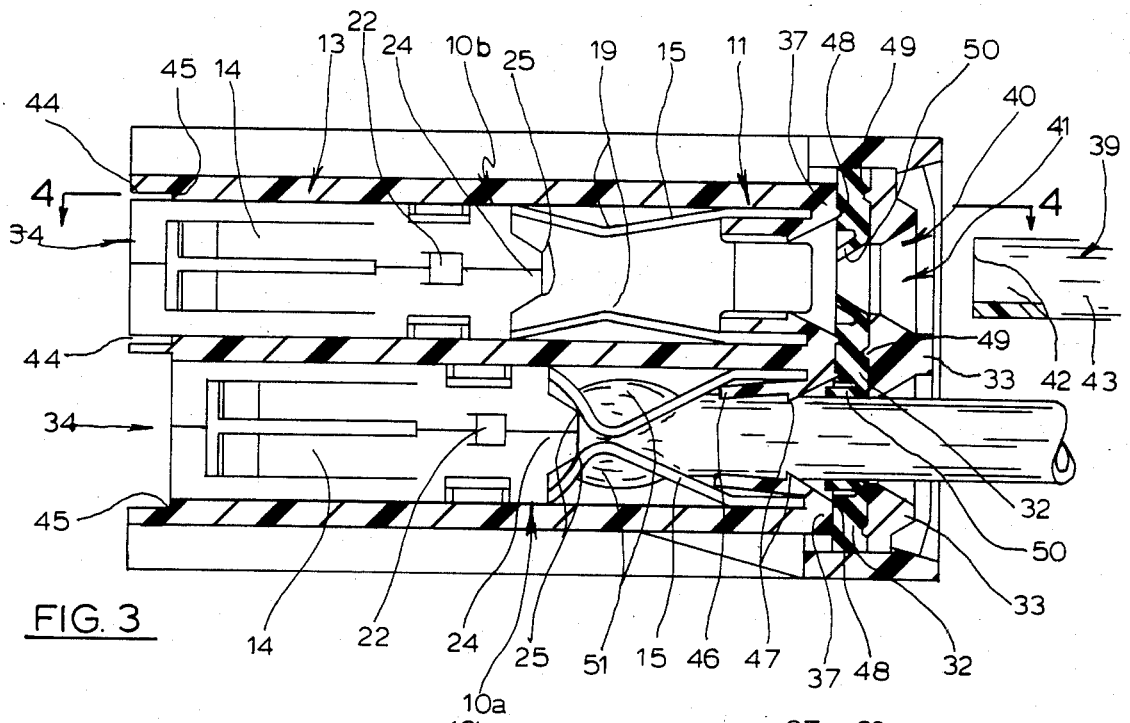
FIG. 3 i a partial side cross-sectional view of the connector of FIG. 2 illustrating the operation of the terminal shown in FIG. 1.
Figure 4:
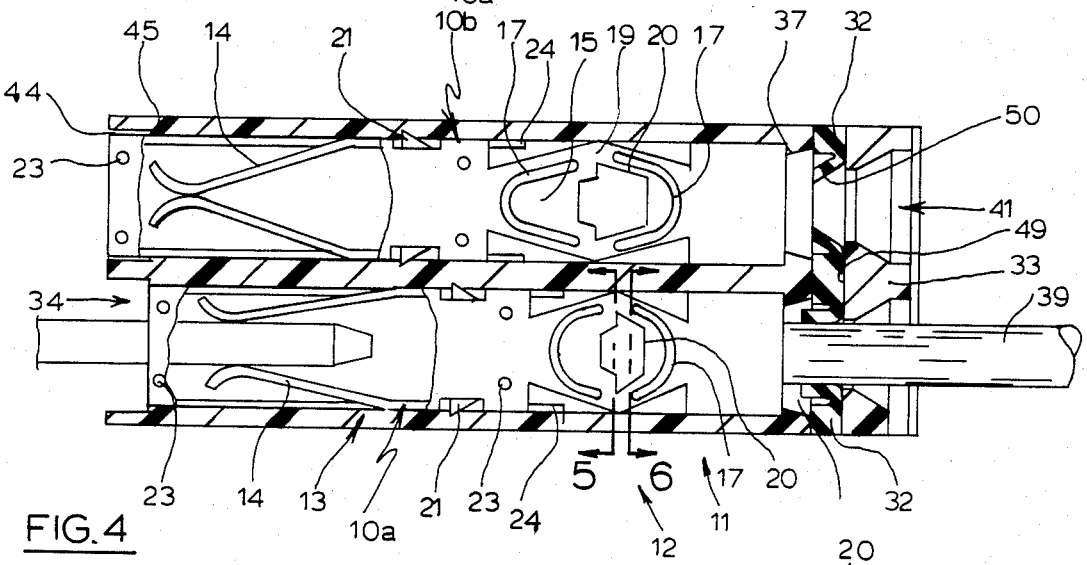
FIG. 4 is a partial sectional view taken generally along the line 4—4 of FIG. 3.

Referring now to FIGS. 3 and 4, the interior structure of the connector assembly 30 is shown, illustrating both an actuated and unactuated terminal 10*a* and 10*b*, respectively, the actuated terminal 10*a* residing in the lower portion of each figure. For proper support of the terminal 10 during actuation, it is preferrable that each cavity 34 have a nominal depth approximately equal to the length of an unactuated terminal 10*b*. Accordingly, in the embodiment of FIGS. 3 and 4 the terminal 10*b* is shown in abutment with the upper wall 37 of the housing 31 and with its lower end approximately co-planar with the lower surface of the housing 31. Recesses 44 are provided in the walls of each cavity 34 defining a continuous ledge 45 around the cavity 34 at a depth approximately equal to the desired distance of travel of terminal end portion 13 upon actuation of the terminal 10.

As best shown in FIG. 3, the upper housing wall 37 is adapted with a plurality of integrally formed re-entrant strain relief tabs, designated generally by the reference numeral 46, extending inwardly into the cavities 34 in opposed pairs. Each tab 46 has a shoulder portion 47 suitable for gripping of the wire 39 upon its termination to the connector 30.

In order to seal the connector 30 after assembly, the upper housing wall 37 is formed with integral ridges 48 extending upwardly around the periphery of each housing aperture 38. Likewise, the gasket retainer 33 is adapted with downwardly extending ridges 49 circumscribing the apertures 41 of the retainer 33. Additionally, the gasket 32 is formed with resiliently deformable collars 50 extending inwardly of the connector housing 31 at each gasket aperture 40 suitably dimensioned to grip the terminated wire 39 in sealing relationship.

With further reference to FIGS. 3 and 4, one method of utlizing the terminal 10 entails bracing the connector housing 31 against a fixed surface (not shown). A wire 39 is moved axially through an appropriate aperture 41 of the gasket retainer 33, then through a corresponding gasket aperture 40 and finally through an aligned housing aperture 38 whereupon it enters the terminal 10 and is urged into abutment with the stops 22 struck from end portion 13 of the terminal 10. Terminal end portion 13 is moved axially inwardly of the housing cavity 34 by application of an axial force imposed upon the terminal 10 by a suitable insertion tool (not shown). The insertion tool is dimensioned so as to be sliding received within the recess 44 of the cavity 34.

Continued insertion of end portion 13 compresses the intermediate portion 12 of the terminal 10 causing the contacting sections 15 to collapse inwardly into the wire 39. The collapsing action of each section 15 is accomplished by the controlled yielding of the terminal material along the axis 19 defined by the notches 18. As collapsing continues, the chamfered edges of apertures 20 come in contact with the insulative coating 42 of the wire 39. At first no cutting occurs in the coating due to the alignment of the aperture 20 over the wire 39 and the resulting cradling of the wire 39 by the aperture 20. However, continued compression of the terminal 10 causes the edges of the apertures 20 to begin to sever and displace the coating 43 of the wire 39. In response to this inward compression and cutting action the insulation covering 42 bulges outwardly as indicated at 51 of FIGS. 3 and 4.

Figure 5:
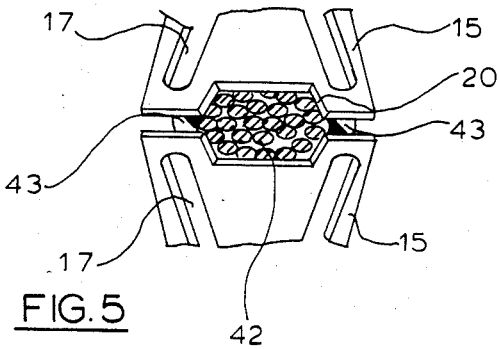
FIG. 5 is a partial sectional view taken generally along the line 5—5 of FIG. 4.
Figure 6:
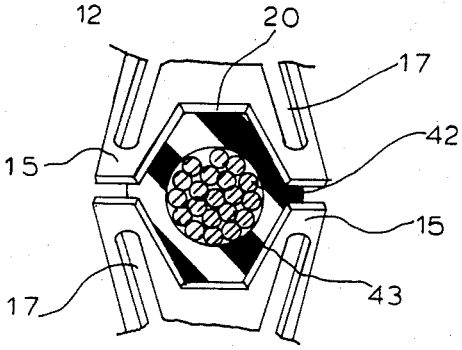
FIG. 6 is a partial sectional view taken generally along the line 6—6 of FIG. 4.
Figure 7A:
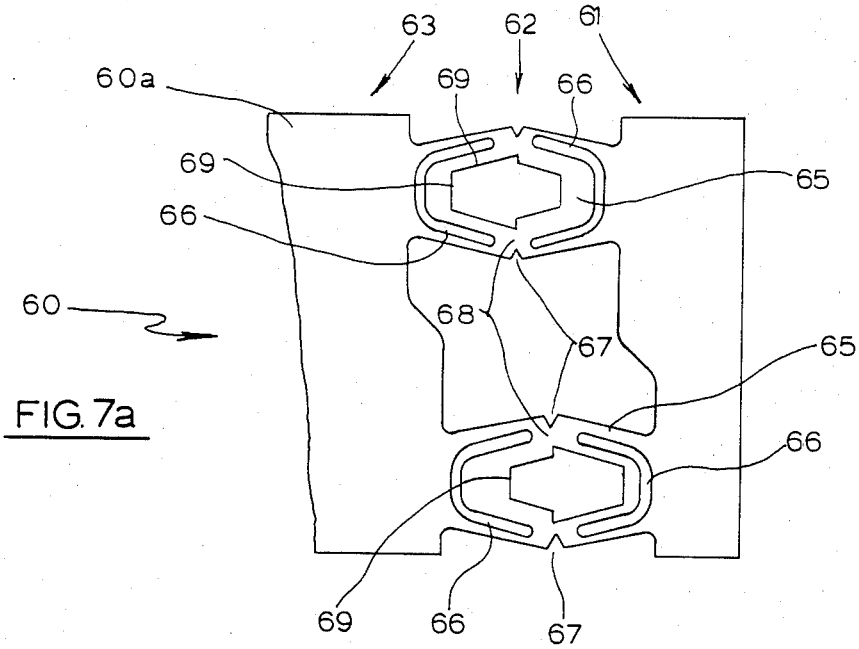
Figure 7B:
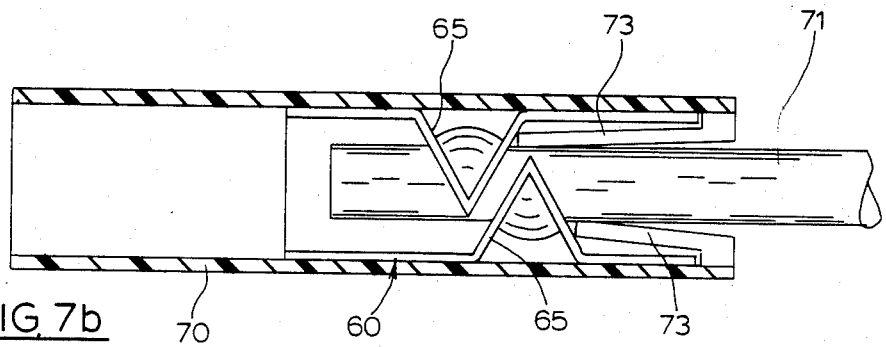
Figure 7C:
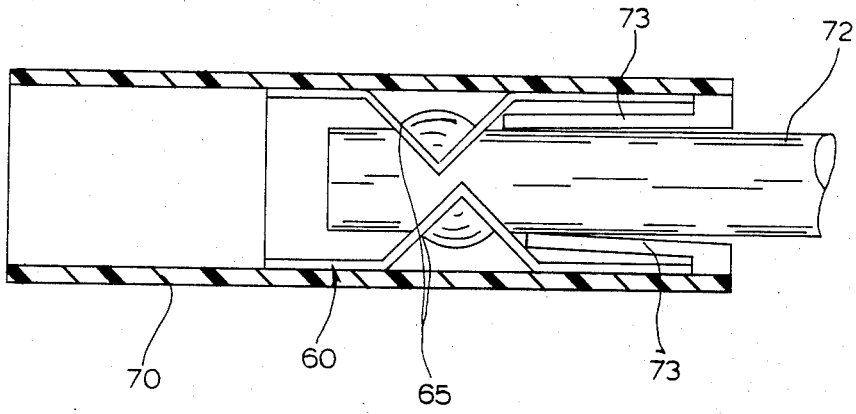

The cradling action of the aperture 20, as best shown in FIGS. 5 and 6, maintains the wire 39 in position during this cutting operation. Because the apertures 20 are shaped assymetrically about the axis of bending 19, one side of each contacting section 15 penetrates the insulation 43 to a greater extent than the opposite side. In this manner less insertion force is required to collapse the terminal 10 into contact with the wire conductor 42. When the cutting edges of the apertures 20 contact the metallic core 42 of the wire 39, as illustrated in FIG. 5, a much greater resistance is encountered and the compression of the terminal 10 may be discontinued.

Terminal end portion 13 may be forced even further such that the ears 24 of housing portion 13 engage the contacting sections 15 are their midpoints causing a slight bowing of each section 15 about the pivot points 25 formed in the ears 24. As best seen in FIG. 3, the bowing of the sections 15 facilitates a slight reorientation of the contacting line of force approaching a force which is normal to the surface of the wire conductor 43 and which remains extant after collapse of the terminal 10 due to the latent resilience of the terminal material. In this loaded state, the contacting sections 15 maintain a good electrical interface with the conductors 43 of the terminated wire 39 against the adverse effects of such transients at vibration, for example.

Ideally, the bowing condition of the contacting sections 15 occurs at the same time that the insertion tool (not shown) bottoms on the ledge 45 formed in the cavity 34 thereby avoiding overstressing of the terminal 10. The teeth 21 of terminal portion 13 thereafter seat into the walls of the cavities 34, maintaining the terminals 10 in fully collapsed and loaded condition within the connector housing 31.

Strain relieving of the wires 39 occurs simultaneously with electrical termination of the wires 39 to the connector 10. As best shown in FIG. 3, re-entrant strain relief tabs 46 extend a sufficient length into the cavities 34 such that as the contacting sections 15 bend inwardly upon collapsing, they bear against the tabs 46 forcing the shoulders 47 to become imbedded in the insulation 42 of the wires 39. The wires 39 are thereby firmly retained in the housing 31 against retrograde forces which might occur during use of the connector assembly.

Where it is desired that the connector assembly 30 have the capability of terminating wire or cable of varying gauges, an alternative embodiment of the instant invention comprising the terminal 60 illustrated in FIGS. *7a*, *7b* and *7c* may be utilized. As best seen in FIG. *7a*, wherein terminal 60 is illustrated as a flat sheet metal blank 60*a* prior to its forming, the terminal 60 is seen to include a first housing end portion 61, an intermediate collapsible portion 62 and a second housing end portion 63.

The intermediate collapsible portion 62 comprises a pair of collapsible contacting sections 65 each adapted with a pair of generally V-shaped reinforcing ribs 66 and a pair of edge notches 67. The ribs 66 and notches 67 together define an axis 68 about which the sections 65 may be bent. A polygonal aperture 69 is formed in each section 65 shaped assymetrically about the axis of bending 68. For the purpose of accommodating wire or cable of varying gauges, in a manner which will be described in greater detail hereinafter, the contacting sections 65 are formed such that they are offset axially one to another yielding the terminal configuration illustrated in FIGS. *7b* and *7c* after the terminal blank 60*a* is formed into a box-like housing.

The operation of the modified terminal 60 may be seen from FIGS. *7b* and *7c* wherein the terminal 60 is shown as having been inserted into a housing 70 and collapsed into contact with a relatively small gauge wire 71 in FIG. *7b* and a relatively large gauge wire 72 in FIG. *7c*. The relative axial displacement of the contacting sections 65 along the length of each terminal 60 permits the section 65 to assume a degree of collapsing compatable with the diameter of the respective terminated wire, without ultimate abutment between pairs of contacters at the axes of bending 68 as would occur in termination of a small diameter wire, were the contacting sections 65 in alignment with one another along the length of the terminal 60.

To provide strain relief for the terminated wires 71, 72, the housing 10 may be adapted with suitable re-entrant strain relief tabs 73. The upper tab 73, as viewed in FIGS. *7b* and *7c*, is slightly longer than the lower tab 73 such that both tabs are acted upon simultaneously by respective contacting sections 65 despite the relative displacement of the sections 65 with respect to the longitudinal axis of the terminal 60.

Referring now to FIGS. 8 and 9, there is shown a still further embodiment of the present invention wherein a collapsible terminal, designated generally by the reference numeral 80, is adapted for terminating a shielded cable 81. The cable 81 generally includes a coaxially arranged conductor core 82 coated with insulation 83, a metalic shielding layer 84 and a surface coating of insulation 85. The terminal 80 is formed into a U-shaped configuration from a sheet metal blank 80*a* having a first end portion 86, an intermediate collapsible portion 87 and a second end portion 88. Notches 89 are formed in the terminal 80 at the junctures of the intermediate portion 87 with end portions 86 and 88 to weaken the terminal 80 for bending at such junctures.

Intermediate portion 87 comprises a pair of opposed contacting sections 90 each having strengthening ribs 91 suitably positioned on opposite sides of intermediate edge notches 92 which together define a line of weakness 93 transversely through the center of each section 90. The sections 90 are further adapted with apertures 94 each configured with teeth 95 extending centrally therewithin. Straps 96 are provided at end portions 86 and 88 connecting the contacting sections 90 in opposed spaced-apart relationship. Gussets 97 are pressed into end portions 86 and 88 lending rigidity to the terminal 80 in its fully formed configuration. Formed from end portion 86 are a pair of inwardly directed collar tangs 98 for centering and supporting an inserted cable 81, and a pair of outwardly directed teeth 99 are provided for engagement with the walls of a housing. A grounding tang 100 extends outwardly from opposite end portion 88.

Turning now to FIG. 9, terminal 80 is shown as fully inserted into a dielectric housing 101 for connection to a printed circuit board 102 or the like. The housing is formed with an open end 103 providing access to a cavity 104 which slidingly receives the terminal 80.

Opposite the open end 103 is a bottom wall 105 having an aperture 106 for passage of a round pin terminal 107.

The pin terminal 107 is formed with a shoulder portion 108 which is received in a complementary recess 109 formed in the bottom wall 105 of the housing 101. A spike 110 formed integrally with the pin 107 extends above the shoulder 108 and into the housing cavity 104 for electrical engagement with the conductor core 82 of the inserted cable 81. Tabs 111 integrally formed with bottom wall 105 extend upwardly into the cavity 104 to provide fulcrums for collapse of each contactng section 90 in a direction suitable to permit the teeth 95 to pierce the insulative coating 85 of the cable 81 and establish electrical contact with the shield 84.

From comparison of the illustrative embodiments, it will be appreciated that the actuation force required to collapse a terminal constructed in accordance with the invention can be transmitted to the terminal by a variety of methods. For example, the terminal 10 of FIGS. 3 and 4 may be actuated, as described hereinabove, by bracing the housing 31 against a fixed surface. In the alternative, the terminal end portion 13 may be braced against an appropriately designed fixture (not shown) while the housing 31 is moved in a direction axially of the terminals 10.

As shown in FIGS. 8 and 9, an acutation force applied to end portion 86 of terminal 80 coincident with the direction of wire insertion, in contrast to the opposite arrangement of FIGS. 3 and 4, is equally possible permitting termination in a single step, for example, by use of a suitable fixture having the capability of inserting the wire and collapsing the terminal in one motion. A wide degree of design variability with respect to housing configurations and uses of the collapsible terminal of the invention are possible, so long as a resultant force is applied axially to the terminal and the terminal is free to collapse in response to such force.

Numerous variations are likewise available for the configuration of the aperture, as is demonstrated by comparison aperture 20 of FIG. 1 and aperture 94 of FIG. 8. The principal design limitations reside in the provision of suitable insulation severing means and proper cradling of the wire during termination.

It should also be apparent from consideration of the above-described illustrative embodiments that the collapsible terminal of the instant invention, due to its axial actuation capability, is particularly suitable for use in high density electrical connectors wherein space limitations require that a multiplicity of circuit terminatios are arranged in a closely spaced array. This departs from known insulation displacement connectors which typically have the capability of wire termination to only two rows of connector terminals because of the requirement that the wire or cable be accessible at the terminal to an actuation force directed transversely to the axis of the cable or wire. Further, axial terminal actuation in accordance with the principles of the invention, and as best illustrated in FIG. 2, permits a connector housing to be completely environmentally sealed by convenient and inexpensive means.

I claim:

1. A connector assembly for terminating an insulated wire having an electrical conductor with a sheath of insulation therearound, including:

a dielectric housing fitted with an electrically conductive terminal said terminal having means for displacing the insulation of said conductor upon relative movement with respect thereto, the improvement comprising:

said displacing means comprising at least one terminal wall portion deflectable into said conductor upon application of a force directed generally parallel to the longitudinal axis of said wire; and tab means integrally formed with said housing for securing said wire in said terminal after its termination to the connector assembly.

2. The connector assembly of claim 1 wherein said tab means are interactable with said wall portions such that upon deflection of the wall portion the tab means deflect into the insulation of said conductor to secure the conductor in said connector assembly.

3. An insulation displacement terminal for electrically connecting an insulated wire having a conductor with a sheath of insulation therearound to another circuit element, said terminal including:

a body positionable about a wire having an insulation covering, said body including an insulation displacing edge, and the improvement of said terminal comprising:

said body is generally U-shaped in cross-section and includes a pair of weakened generally opposed side wall portions at least one of which includes said insulation displacing edge, and a pair of cross members connecting said side wall portions at the ends of said side wall portions; and means for causing said displacing edge to move into said insulation covering in a direction generally transverse to the length of said wire in response to an actuating force applied to said body generally parallel to the length of said wire.

4. The terminal of claim 3 including an aperture located on each side portion, said apertures arranged to weaken said side portions.

5. The terminal of claim 4 wherein said insulation displacing edge is defined by an edge portion of said apertures.

6. The terminal of claim 4 wherein said apertures cooperate to cradle said wire upon movement of said insulation displacing edge into said wire,

7. The terminal of claim 6 wherein the aperture in one portion is offset along the longitudinal centerline of the terminal with respect to the aperture in the other portion.

8. A collapsible insulation displacement terminal including:

a body positionable about and extending along an insulated wire having a conductor with a sheath of insulation therearound, said body including an insulation displacing edge, and the improvement of said terminal comprising:

a pair of wall portions of said body arranged in opposed relationship to one another each of said portions being deflectable inwardly toward one another in response to a force applied axially of said terminal, said deflection occurring as a result of the weakening of each wall portion along a fold line defined by notches in said wall portions, running generally transverse to the terminal; and said body further includes tab means interactable with said wall portions for bowing the wall portions as they are deflected inwardly toward one another, thereby altering the angle of incidence of said displacing edge with respect to said conductor.

9. A connector assembly for electrically connecting an insulated wire having a conductor with a sheath of insulation therearound to another circuit element, said assembly comprising a dielectric housing including a first end having a wire receiving aperture, a second end, and a terminal receiving cavity located therebetween, a terminal fitted in said housing cavity, the terminal having a first end abutting said first housing end, and a second end located adjacent said second housing end, said terminal further having a unitary, elongated, stamped metallic body with a wire receiving region formed therein for receiving an insulated wire, and insulation displacement means adapted to slice through the insulation and electrically engage the conductor when said insulation displacement means is moved towards said wire, the improvement in said assembly comprising:

said terminal body comprising a weakened section having two axially spaced ends and a fold line, said fold line and said insulation displacement means located intermediate the spaced ends, said weakened section being collapsible at said fold lines when an axially compressive force is applied to said first housing end and said second terminal end to move said weakened section from an initial position inwardly to a collapsed position into the wire receiving region, whereby said insulation displacement means is moved towards said wire, slicing through said insulation and electrically engaging said conductor.

10. The connector assembly of claim 9 including strain relief tab means formed integrally with said housing adjacent said first end thereof, for securing said wire in said housing after its termination to the terminal.

11. The connector assembly of claim 10 wherein said strain relief tab means are interactable with said weakened section such that said weakened section when collapsed, deflects said strain relief tab means into said wire insulation to secure the wire in said connector assembly.

12. The connector assembly of claim 9 further including sealing means for sealing said conductor in said housing upon insertion of the conductor therein, said sealing means comprising a gasket mounted on the first end of the housing having a resiliently deformable collar surrounding said wire receiving aperture for creating a seal with said conductor when inserted therethrough.

13. The connector assembly of claim 12 wherein said sealing means is operable to seal said wire in the housing prior to collapse of said weakened section.

14. The connector assembly of claim 9 including means for sealing said conductor in said housing upon insertion of the conductor therein.

15. The connector assembly of claim 14 wherein said sealing means comprises a gasket having a resiliently deformable collar for creating a seal with a conductor inserted through said gasket.

16. The connector assembly of claim 14 wherein said sealing means is operable to seal said conductor in the housing prior to deflection of said terminal wall portion into said conductor.

17. An insulation displacement terminal for electrically connecting an insulated wire having a conductor with a sheath of insulation therearound to another circuit element, said terminal including an unitary, elongated, stamped metallic body having a wire receiving region formed therein for receiving an insulated wire, and insulation displacement means adapted to slice through the insulation and electrically engage the conductor when said insulation displacement means is moved towards said wire, the improvement in said body comprising:

a weakened section including two axially spaced ends and a fold line, said fold line and said insulation displacement means located intermediate said ends, said weakened section being collapsible at said fold line when said body is axially compressed from an initial position, inwardly to a collapsed position into the wire receiving region to electrically engage the wire.

18. The terminal of claim 17 wherein the insulation displacement means includes an aperture formed in the weakened section through the fold line and having a peripheral edge which is adapted to slice through the insulation when the body is collapsed.

19. The terminal of claim 17 wherein the body includes a second weakened section spaced from and parallel to the other weakened section so that the wire is between said two weakened sections, said second weakened section having a fold line and insulation displacement means, said second weakened section being collapsible in the same manner as the first weakened section when the body is axially compressed whereby the insulation displacement means of the second weakened section electrically engages the wire from a direction opposite the insulation displacement means of the first weakened section.

* * * * *